US007175441B2

(12) United States Patent
Naviaux et al.

(10) Patent No.: US 7,175,441 B2
(45) Date of Patent: Feb. 13, 2007

(54) MULTIPLE POSITIONING AND SWITCHING

(75) Inventors: Jacques Naviaux, Rancho Palos Verdes, CA (US); Peter J. Balsells, Newport Beach, CA (US)

(73) Assignee: Bal Seal Engineering Co., Inc., Lake Forest, CA (US)

( * ) Notice: Subject to any disclaimer, the term of this patent is extended or adjusted under 35 U.S.C. 154(b) by 0 days.

(21) Appl. No.: 11/278,366

(22) Filed: Mar. 31, 2006

(65) Prior Publication Data

US 2006/0221625 A1 Oct. 5, 2006

Related U.S. Application Data

(60) Provisional application No. 60/668,482, filed on Apr. 5, 2005.

(51) Int. Cl.
*H01R 39/00* (2006.01)
*H01R 41/00* (2006.01)

(52) U.S. Cl. ..... 439/8; 439/10; 362/421

(58) Field of Classification Search ..... 439/8, 439/6, 10, 11; 362/421
See application file for complete search history.

(56) References Cited

U.S. PATENT DOCUMENTS 2,020,088 A * 11/1935 Truswell ..... 439/8
2,652,546 A * 9/1953 Christner ..... 439/8
2,655,637 A * 10/1953 Godfrey et al. ..... 439/10

* cited by examiner

*Primary Examiner*—Hae Moon Hyeon
(74) *Attorney, Agent, or Firm*—Walter A. Hackler

(57) ABSTRACT

A multiple positioning assembly includes a housing having a cavity therein with a circumferential groove disposed proximate a cavity opening. A ball assembly including a ball portion forms a spheroidal joint with the cavity which enables conical movement of the ball assembly. A plunger is slidably disposed within a bore through the ball portion of the ball assembly and electrical connections enable lateral movement of the plunger to control power to a light bulb attached to the plunger.

10 Claims, 2 Drawing Sheets

MULTIPLE POSITIONING AND SWITCHING

RELATED APPLICATION

The present application claims priority from the U.S. Provisional Patent Application, Ser. No. 60/668,482 filed Apr. 5, 2005, which is to be incorporated herein in its entirety including all specification and drawings.

BACKGROUND OF THE INVENTION

The present invention generally relates to electrical connectors and more specifically relates to a novel electrical light fixture which may be adjusted in multiple directions and further specifically relates to lamps or other electrical devices having a requirement for various light intensities.

Swivel type lamps having a conical movement have been used extensively for years. However, many of these devices have a complex and unsightly appearance often with obtrusive locking devices and separate controls for light intensity.

The present invention incorporates the use of a design incorporating canted coil springs to provide electrical connection in addition to latching, longitudinal positioning, and conical movement of a light fixture.

SUMMARY OF THE INVENTION

A multiple positioning assembly in accordance with the present invention generally includes a housing having a cavity therein with a circumferential groove disposed proximate a cavity opening.

A ball assembly, including a ball portion, forms a spheroidal joint with the cavity and enables conical movement of the ball assembly.

The ball assembly includes a bore therethrough with a subtending groove.

A coil spring disposed in the circumferential groove maintains the ball portion within the cavity at any desired angular orientation. Spring loading of the ball portion provides stabilization of the ball assembly.

A plunger is slidably disposed in the ball assembly bore with the plunger having a plurality of spaced apart indentations thereon proximate one end and a lamp fixture, preferably a light bulb socket, at another end thereof.

Springs, preferably canted coil springs, disposed in the subtending groove engage, in a serial manner, each of the spaced apart indentations thereby enabling lateral positioning of the plunger within the ball assembly bore. As hereinafter described, these various lateral positions of the plunger enable switching of electrical current in order to provide conventional three-way electrical control to the socket.

In one embodiment, the bore has a plurality of subtending grooves and the springs disposed therein are axial canted coil spring segments. Electrical contacts disposed in the indentations, and electrical connectors axially disposed within the plunger provide electrical continuity. Electrical input wires are connected to the spring segments in order to provide electrical power through the contacts and conductors to the socket depending upon the lateral position of the plunger within the ball assembly bore.

BRIEF DESCRIPTION OF THE DRAWINGS

The advantages and features of the present invention will be better understood with the following detailed description when considered in conjunction with the accompanying drawings, of which.

DETAILED DESCRIPTION

Figure 1:
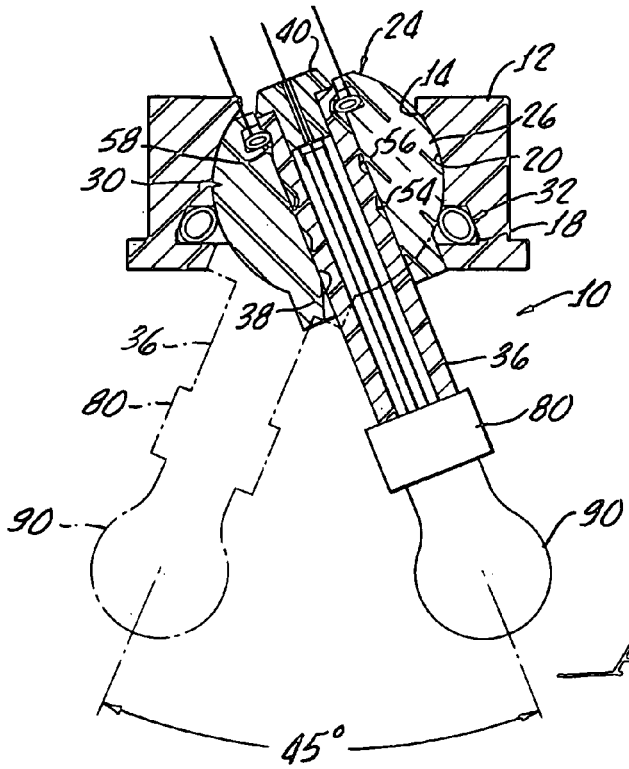
FIG. 1 is a cross sectional view of a multiple positioning assembly in accordance with the present invention generally showing a housing having a cavity therein along with a circumferential groove and a ball assembly including a ball portion disposed within the cavity, and a plunger slidably disposed in a ball assembly bore, a spheroidal joint enables conical movement of up to 45° as illustrated between solid lines and dashed lines in the figure.
Figure 8:
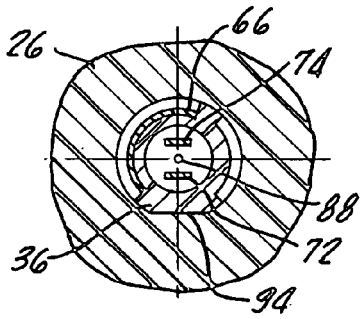
FIG. 8 is a cross sectional view taken along the line 8—8 of FIG. 6.
Figure 9:
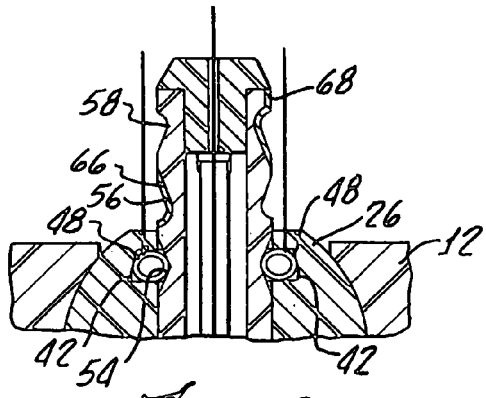
FIG. 9 is a cross sectional view taken along the view 9—9 of FIG. 3.

With reference to FIG. 1, there is shown a multiple positioning assembly in accordance with the present invention generally including a housing 12 having a cavity 14 therein with a circumferential groove 18 disposed proximate a cavity opening 20.

A ball assembly 24 includes a ball portion 26 disposed within the cavity 14 and forming a spheroidal joint 30 therebetween. A garter spring 32, preferably a canted coil spring, is disposed in the circumferential groove 18 which retains the ball portion in the cavity 14 at desired angular orientations as illustrated in FIG. 1 along with a plunger 36 slidably disposed in a ball assembly bore 38.

Conical movement of the ball portion 26 and plunger 36 of up to 45° can be seen in FIG. 1 by comparison of the solid line plunger 36 and a dashed line plunger 36. It should be appreciated that the materials of construction of all the components of the present invention are conventional materials typically used in the lamp fixtures and the like.

Figure 2:
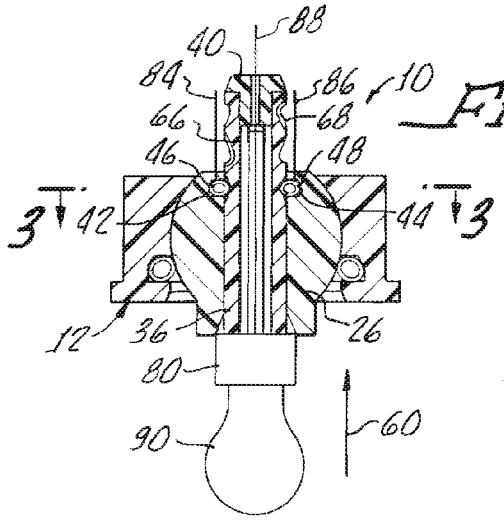
FIG. 2 is a cross sectional view similar to that shown in FIG. 1 with the plunger in a vertical direction and disposed in an electrically off position.
Figure 3:
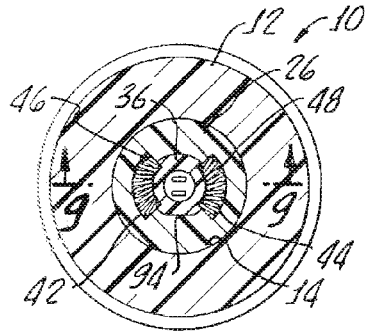
FIG. 3 is a cross sectional view taken along line 3—3 of FIG. 2.
Figure 4:
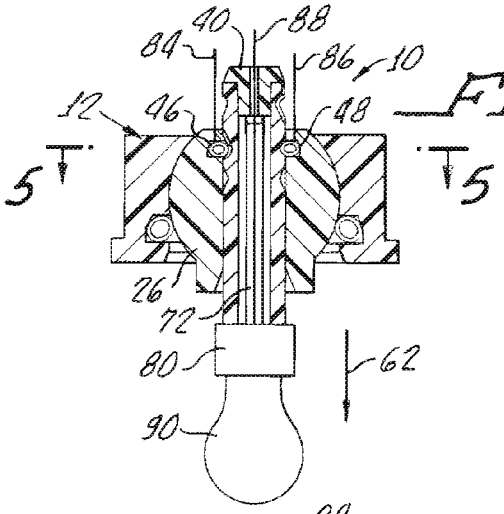
FIG. 4 is a view of the assembly is similar to FIG. 2 with the plunger disposed in an intermediate or "dim" position.
Figure 5:
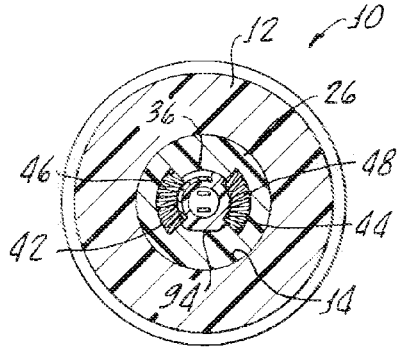
FIG. 5 is a cross sectional view taken along the line 5—5 of FIG. 4.
Figure 6:
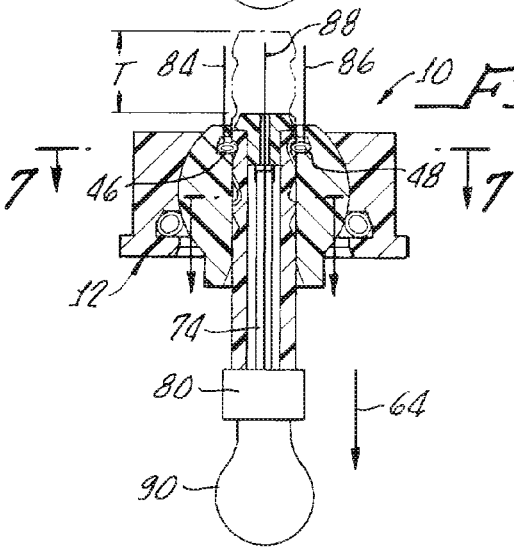
FIG. 6 is a view similar to FIGS. 2 and 4 with the plunger disposed in an "on" position providing electrical current to the light bulb.
Figure 7:
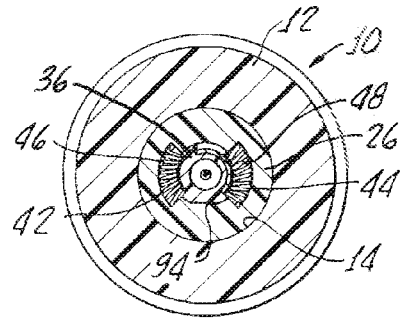
FIG. 7 is a cross sectional view taken along the line 7—7 of FIG. 6.

As shown in FIGS. 1–7, and 9, the ball portion 26 further includes grooves 42, 44 subtending the bore 38 proximate a plunger end 40 which in combination with springs segments 46, 48 therein and indentations 54, 56, 58 in the plunger 36, enable lateral positioning of the plunger at 36 within the ball portion bore 38 as illustrated in FIGS. 2, 4, and 6 by arrows 60, 62, 64. As most clearly shown in FIG. 9, electrical contacts 66, 68 are disposed respectively in indentations 56, 58.

Electrical strips 72, 74, interconnected respectively to contacts 66, 68, provide electrical continuity between a socket 80 through springs 46, 48 and electrical contacts 66, 68 respectively to electrical input wires 84, 86 and ground wire 88.

Plunger 36 travel between positions shown in FIG. 2, FIG. 4, and FIG. 6 illustrated by T in FIG. 6, provides for an "off" position for a three way light bulb 90, shown in FIG. 2, to a "dim" or intermediate position, shown in FIG. 4, and a "full on" position as shown in FIG. 6. Connections of the socket and conventional three-way light bulb are not shown for brevity.

To prevent rotation of the plunger 36 within the bore 38, a flat 94 is provided on the plunger 36 as illustrated in FIGS. 3, 5, 7, and 8.

As can be seen, the assembly 10 provides for not only positioning the light bulb 90 in any conical position, but further enables, without further circuitry or switching, the control of power to the light bulb by simple lateral movement of the plunger socket and light bulb within the bore 38.

Although there has been hereinabove described a specific multiple positioning and switching in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A multiple positioning assembly comprising:

a housing having a cavity therein with a circumferential groove disposed proximate a cavity opening;

a ball assembly including a ball portion forming a spheroidal joint with said cavity and enabling conical movement of the ball assembly, said ball portion having a bore therethrough with a subtending groove;

a garter spring disposed in said circumferential groove and retaining said ball portion within said cavity at desired angular orientations;

a plunger slideably disposed in the ball portion bore, said plunger having a plurality of spaced apart indentation therein;

a spring disposed in said subtending groove and engaging in a serial manner each of the spaced apart indentations to enable lateral positioning of said plunger within the ball portion bore.

2. The assembly according to claim 1 wherein said bore has a plurality of subtending grooves and springs disposed therein are axial canted coil spring segments.

3. The assembly according to claim 1 further comprising an electrical contact disposed in at least one of the indentations.

4. The assembly according to claim 2 further comprising electrical conductors axially disposed within said plunger, at least one conductor connected to a corresponding contact.

5. The assembly according to claim 4 further comprises an electrical socket disposed at an end of said plunger and interconnecting the conductors.

6. The assembly according to claim 5 further comprising electrical input wires connected to said spring segments in order to provide electric power through said contacts and conductor to the socket depending on the lateral position of said plunger with the ball assembly bore.

7. A multiple positioning assembly comprising:

a housing having a cavity therein with a circumferential groove disposed proximate a cavity opening;

a ball assembly including a ball portion forming a spheroidal joint with said cavity and enabling conical movement of the ball assembly, said ball portion having a bore therethrough with a plurality of subtending groove;

a garter spring disposed in said circumferential groove and retaining said ball portion within said cavity at desired angular orientations;

a plunger slideably disposed in the ball portion bore, said plunger having a plurality of spaced apart indentation therein proximate one end thereof and a light bulb socket at another end thereof;

springs disposed in corresponding subtending groove and engaging in a serial manner each of the spaced apart indentation to enable lateral positioning of said plunger within the ball portion bore.

8. The assembly according to claim 7 further comprising an electrical contact disposed in at least one of the indentations.

9. The assembly according to claim 7 further comprising electrical conductors axially disposed within said plunger, at least one conductor connected to a corresponding contact, and the socket.

10. The assembly according to claim 9 further comprising electrical input wires connected to said spring segments in order to provide electric power through said contents and conductor to the socket depending on the lateral portion of said plunger with the ball assembly bore.

* * * * *